US010485311B2

(12) United States Patent
Armani et al.

(10) Patent No.: US 10,485,311 B2
(45) Date of Patent: Nov. 26, 2019

(54) LUGGAGE COMPRISING A FOLDABLE STRUCTURE

(71) Applicant: DELSEY, Tremblay en France (FR)

(72) Inventors: Lorenzo Armani, Paris (FR); Laurence Detry, Paris (FR)

(73) Assignee: DELSEY, Tremblay en France (FR)

( * ) Notice: Subject to any disclaimer, the term of this patent is extended or adjusted under 35 U.S.C. 154(b) by 123 days.

(21) Appl. No.: 15/879,383

(22) Filed: Jan. 24, 2018

(65) Prior Publication Data

US 2018/0146755 A1 May 31, 2018

Related U.S. Application Data

(60) Division of application No. 14/814,367, filed on Jul. 30, 2015, now abandoned, which is a continuation-in-part of application No. PCT/FR2015/050174, filed on Jan. 26, 2015.

(51) Int. Cl.

| | |
|---|---|
| ***A45C 5/03*** | (2006.01) |
| ***A45C 7/00*** | (2006.01) |
| ***A45C 5/14*** | (2006.01) |
| ***A45C 13/36*** | (2006.01) |

(52) U.S. Cl.

CPC ..... *A45C 7/0031* (2013.01); *A45C 5/03* (2013.01); *A45C 5/14* (2013.01); *A45C 5/146* (2013.01); *A45C 7/0018* (2013.01); *A45C 7/0022* (2013.01); *A45C 7/0036* (2013.01); *A45C 13/36* (2013.01); *A45C 2005/148* (2013.01)

(58) Field of Classification Search

CPC ..... A45C 7/0031; A45C 5/03; A45C 5/14; A45C 5/146; A45C 7/0018; A45C 7/0022; A45C 7/0036; A45C 13/36; A45C 2005/148

See application file for complete search history.

(56) References Cited

U.S. PATENT DOCUMENTS

| | | | | |
|---|---|---|---|---|
| 844,955 | A | 2/1907 | Morgan | |
| 2,461,482 | A | 2/1949 | Schaus | |
| 2,564,939 | A | 8/1951 | Weast | |
| 3,191,959 | A | 6/1965 | Heimbruch et al. | |
| 3,447,648 | A | 6/1969 | Schwennicke | |
| 4,562,952 | A | 1/1986 | Chinman | |
| 5,310,208 | A * | 5/1994 | Jarke | A47C 4/04 280/643 |
| 5,505,297 | A | 4/1996 | Myers | |
| 6,073,943 | A | 6/2000 | Serrault | |

(Continued)

FOREIGN PATENT DOCUMENTS

| | | | |
|---|---|---|---|
| BE | 1 014 934 | A7 | 6/2004 |
| EP | 1 958 885 | A1 | 8/2008 |
| WO | 2013028974 | A2 | 2/2013 |

*Primary Examiner* — Tri M Mai

(74) *Attorney, Agent, or Firm* — Im IP Law; C. Andrew Im; Chai Im

(57) ABSTRACT

A luggage with a foldable structure between a conformation of reduced volume suitable for the stowage and a developed conformation with a volume suitable for use. The luggage has an access face and a bottom opposite to the access face. The bottom is bordered by four side faces. At least one of the two side faces is associated at least one stiffening panel, that is configured to swivel towards the bottom of the luggage. A third side face has a foldable structure lockable by a side locking device.

5 Claims, 4 Drawing Sheets

(56) References Cited

U.S. PATENT DOCUMENTS

| | | | | |
|---|---|---|---|---|
| 6,516,751 | B2 | 2/2003 | Burns et al. | |
| 9,375,063 | B2 * | 6/2016 | Chen | A45C 7/0054 |
| 9,681,717 | B2 | 6/2017 | Meersschaert et al. | |
| 2003/0038009 | A1 * | 2/2003 | Chang | A45C 5/02 190/127 |
| 2005/0034948 | A1 | 2/2005 | Tiramani | |
| 2006/0011686 | A1 | 1/2006 | Latham | |
| 2007/0158157 | A1 | 7/2007 | Krulik et al. | |
| 2009/0057307 | A1 | 3/2009 | Jung et al. | |
| 2010/0282556 | A1 * | 11/2010 | Tseng | A45C 7/0077 190/107 |
| 2011/0162931 | A1 | 7/2011 | Collins et al. | |

* cited by examiner

LUGGAGE COMPRISING A FOLDABLE STRUCTURE

RELATED APPLICATION

This application is a divisional of application Ser. No. 14/814,367 filed Jul. 30, 2015, which is a continuation-in-part of international application PCT/FR2015/050174 filed on Jan. 26, 2015, which claims priority from French application FR1450645 filed on Jan. 27, 2014, each of which is incorporated herein by reference in its entirety.

TECHNICAL FIELD OF THE INVENTION

The invention relates to a luggage comprising a structure, said structure being foldable between a folded-up conformation with a reduced volume suitable for the stowage and a developed conformation with a volume suitable for use.

The invention is particularly, but not exclusively, suited for a luggage comprising four casters.

BACKGROUND OF THE INVENTION

According to prior art, a luggage comprising wheeling casters and a telescopic handle generally consists of a floor with side frameworks, combined with a polypropylene sheet exhibiting a C shape conformation.

This design of the floor and of the side frameworks, makes it possible to maintain the spacing, the rigidity and the coplanarity of the wheels, while enabling a good efficiency of driving with the telescopic handle, by providing a force flow path through multiple rigid components, i.e. the side frameworks and the propylene sheet, from the handle to the casters.

The document WO2013/028974 discloses a foldable luggage, comprising a lower surface, which comprises a rigid front part and a rigid back part. The said front and back rigid parts are connected so as to shift from a substantially coplanar configuration to a substantially perpendicular configuration. A locking mechanism is arranged so as to lock the aforementioned front and back rigid parts in the said substantially coplanar configuration. This foldable luggage comprises an upper surface, comprising a front part and a back part. The aforementioned front and back parts of the upper surface are arranged so as to be able to shift from a substantially coplanar configuration to a substantially perpendicular configuration. This foldable luggage comprises a back surface, a left side surface, a right-side surface, and a front surface. The luggage can be in a deployed configuration, when in use, and can be in a folded-up configuration for stowage. In the said deployed configuration, the said front and back parts of the bottom surface are locked in the said substantially coplanar configuration, and the aforementioned front and back parts of the upper surface are positioned in the said substantially coplanar configuration. In the said folded up configuration, the aforementioned front and back parts of the bottom surface are arranged in the said substantially perpendicular configuration, and the said front and back parts of the upper surface are positioned in the said substantially perpendicular configuration.

The locking mechanism of the foldable luggage disclosed in the document WO2013/028974 is located in the middle of the bottom surface, so that the force flows on the sides, i.e. between the two front and aft wheels on the left side and the two front and aft wheels on the right side, are unbalanced.

This disclosed locking system is not satisfactory, because it does not provide a locking from one to the other of the front and the back rigid parts that is suitable for important loads.

This locking system as disclosed is also unsatisfactory regarding the resistance to a throwing test, because the front and the back rigid parts do not stay coplanar.

This locking system as disclosed, is finally unsatisfactory when wheeling, because the front and the back rigid parts do not also stay coplanar, from where it follows that the force flows, from the top to the bottom of the product, are deficient and that the wheeling is imperfect.

OBJECT AND SUMMARY OF THE INVENTION

The aim of the invention is to provide a luggage with a light weight structure comprising casters for wheeling, said luggage allowing, both, being folded to a reduced footprint when stowed, but providing an easy and efficient driving when used loaded.

To this end the invention relates to a substantially prismatic foldable luggage comprising casters and a driving handle and, when in use, a hard floor, a hard bottom and two hard sides, the floor extending between aft and front trihedral junctions with the sides, wherein:

At least one part of the floor and one part of the sides are made of a panel hinged with respect to the bottom, according to a hinge axis parallel to the bottom plane;

Each caster is located close to a trihedral junction between the edges of the floor and the edges of one of the sides;

Locking means are set between the sides and the floor panels so as to secure the trihedral junctions where the casters are located.

Therefore, as the casters are located close to the trihedral junctions between the floor and the sides the force flow from the handle to the casters can follow multiple path through rigid components, thus enabling an easy driving, while the locking means stiffens the areas that are the more sensitive with regard to the load transfer when wheeling or when the suitcase is thrown.

The invention can be implemented according to the advantageous embodiments described below, which may be considered individually or in any technically operative combination.

In all the disclosed embodiments, a hinge can be made either by mechanical means such as a spindle running through bushings or by a seam between two textile envelopes, said envelopes being wrapped over a rigid framework and sewed together so as to create a folding line.

According to a first embodiment, the locking means of the luggage according to the invention comprise a shoulder at the edge of one of the locked panels. This shoulder is either located on the edge of the side panel, this embodiment being more suitable for a 2 wheel luggage or on the edge of the floor, this last embodiment being more suitable for a 4 wheels suitcase.

Advantageously, the casters are attached to the floor with casings having an interior part, said interior part comprising a shoulder groove adapted to lock the edge of a side panel. Therefore, the shoulder is part of the floor panel but, being integral with the caster casings, favors the conveyance of the driving forces to the wheels.

In a variant adapted to a 2 wheels suitcase, wheeling casters consist in 2 aft wheels and the shoulder is part of a side panel.

Advantageously, the luggage according to the invention, comprises a panel made of a webbed plastic framework wrapped in a textile envelope.

BRIEF DESCRIPTION OF THE DRAWINGS

The invention is described hereafter in its preferred embodiments, in no way limiting, and with reference to the figures, in which.

DETAILED DESCRIPTION OF THE EMBODIMENTS

Figure 1:
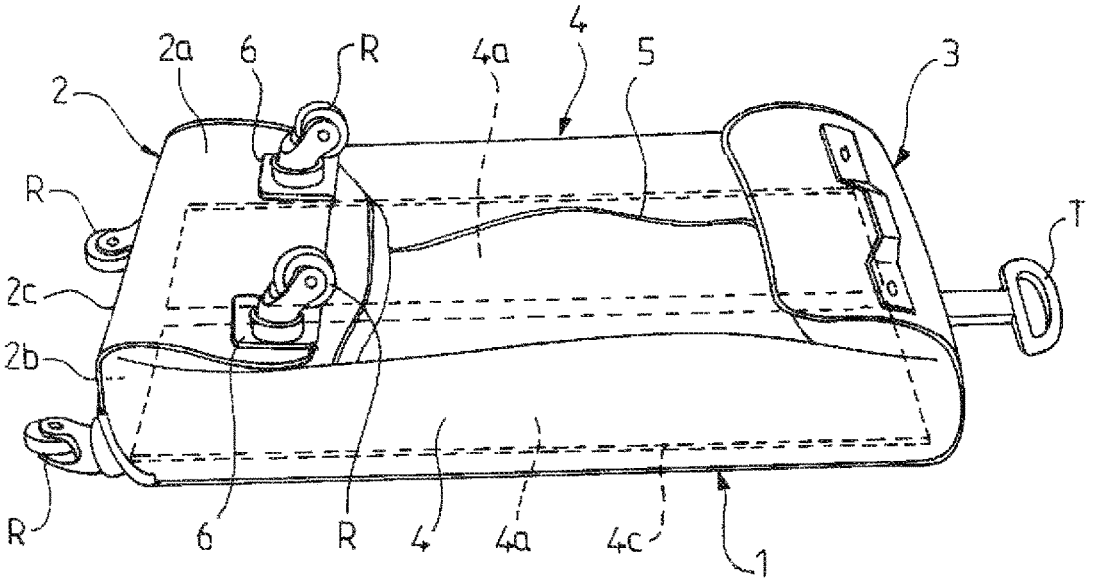
FIG. 1 schematically represents a perspective view of an embodiment of a luggage according to the invention, in a folded-up conformation of reduced footprint suitable for stowage.

According to FIG. 1, a luggage with a foldable structure according to the invention is a luggage with casters R and a telescopic handle T, comprising a bottom 1, a floor 2 and a ceiling 3.

According to this embodiment, the luggage comprises four wheels R.

Two side faces are extending from the bottom 1, between the floor 2 and the ceiling 3.

An access face 5, through a zipper, opposite the bottom 1 borders the side faces 4, the floor 2 and the ceiling 3.

Figure 2:
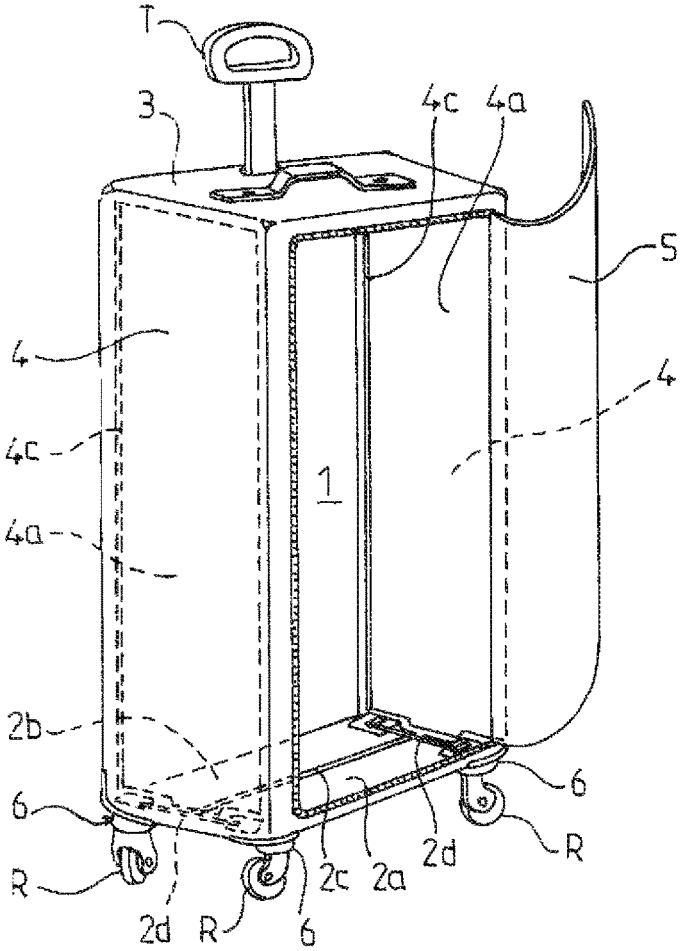
FIG. 2 schematically represents a perspective view of a luggage according to an embodiment of the invention in a developed conformation, suitable for use.

The floor 2 is a foldable floor between a conformation of reduced volume suitable for the stowage of the luggage as shown on FIG. 1, and a conformation of high volume, as shown on FIG. 2.

The floor 2 comprises two parts: a rigid front part 2*a* and a rigid back part 2*b*, linked by a hinge 2*c*.

The hinge 2*c* may be made by a seam of textile envelopes sewed with the rigid parts 2*a* and 2*b* of the floor 2, so that the front part is able to rotate towards the interior of the product.

The rigid parts 2*a* and 2*b* of the floor 2 are folded up at a substantially right angle in the conformation of reduced volume suitable for stowage, so as to reduce the thickness of the floor 2.

Figure 5:
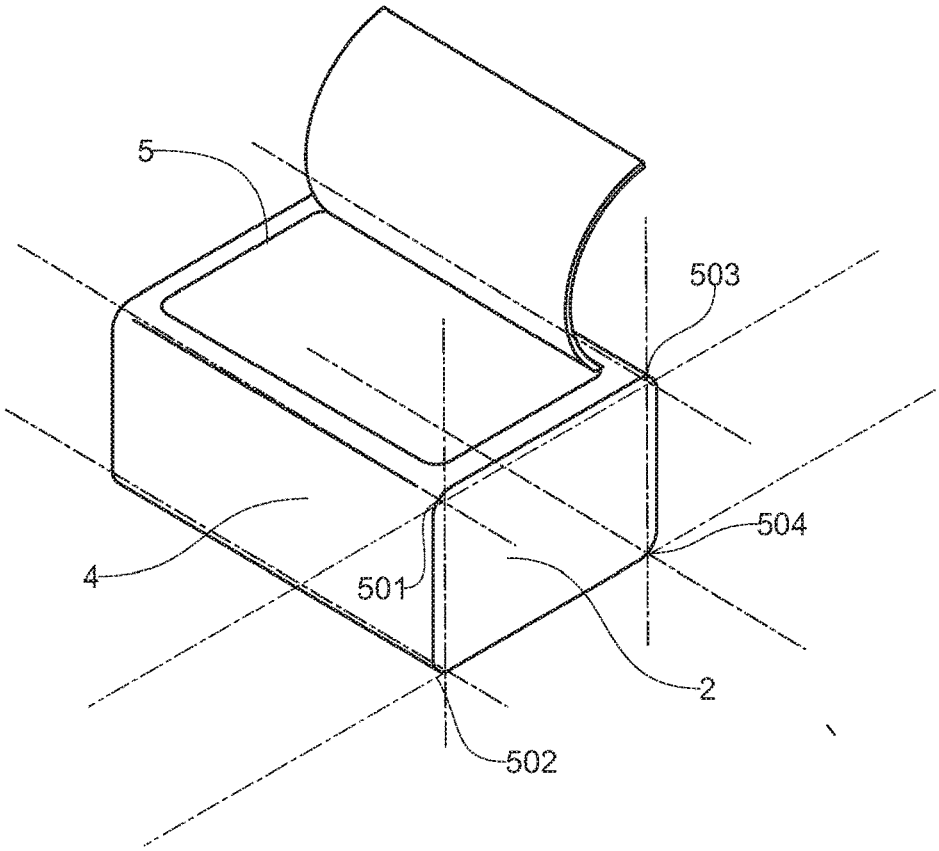
FIG. 5, shows schematically in a perspective view and exemplary embodiment of a luggage according to the invention.

Considering FIG. 5, when the luggage according to the invention comprises wheels or casters, these wheels are preferably located as close as possible to the trihedral junctions 501 . . . 504, between the edges of the floor 2 and the edges of the sides 4*a*, 4*b*. These areas are commonly designated as corner fittings for a suitcase, and are the stiffest parts of the luggage. As a consequence, these trihedral junctions are particularly suited to bear the casters and in order to provide a force flow from the load carried by the luggage to the ground through the casters, the side panels 4 and the floor panel 2 are advantageously secured together in these areas.

Coming back to FIG. 1, the rigid parts 2*a* and 2*b* of the floor 2 are each provided with two casters R arranged laterally in the vicinity of the side faces 4.

The front part 2*a* of the floor 2 is thus a rigid part, which carries two casings 6 for bearing the casters R.

The rear part 2*b* of the floor 2 is also a rigid part which carries two other casings 6 for bearing the casters R.

The ceiling 3 of the luggage with casters R and a telescopic handle T is generally made of a polypropylene sheet exhibiting a C shape conformation, extending from the bottom 1 and constituting the return. The ceiling 3 exhibits an opening, enabling the installation of the telescopic handle T.

The invention also covers and not shown alternative of a luggage with a ceiling 3, foldable between a conformation of reduced volume suitable for the stowage of the luggage shown in FIG. 1 and a conformation of high volume shown on FIG. 2. The ceiling 3 of this not shown alternative of a luggage with a foldable structure according to the invention, may comprise to this end a front part and a back part that may be folded up at a substantially right angle, in the conformation of reduced stowage volume. The front and the back parts of the ceiling 3 can be complementary in the vicinity of the side faces 4, so as to constitute a substantially rigid ceiling 3.

The side faces 4 extending from the bottom 1, between the floor 2 and the ceiling 3 are associated with stiffening panels 4*a* adapted to swivel towards the bottom of the luggage.

These swiveling rigid panels 4*a* are installed inside the structure of the luggage with a foldable structure, so as to constitute a stiffening framework in the conformation of high volume shown on FIG. 2.

The stiffening panels 4*a* are fixed on the bottom 1 of the luggage with a foldable structure, and are not fixed on their other sides, so as to be able to rotate and to fold up inside the structure of the luggage with a foldable structure.

These stiffening panels 4*a* thus swivel inside the structure of the luggage with a foldable structure, in the conformation of reduced volume for the stowage of the luggage, shown in FIG. 1.

The pair of rigid swiveling panels 4*a* is thus folded up one on the other in the conformation of reduced volume, for stowage of the luggage shown in FIG. 1.

Figure 8:
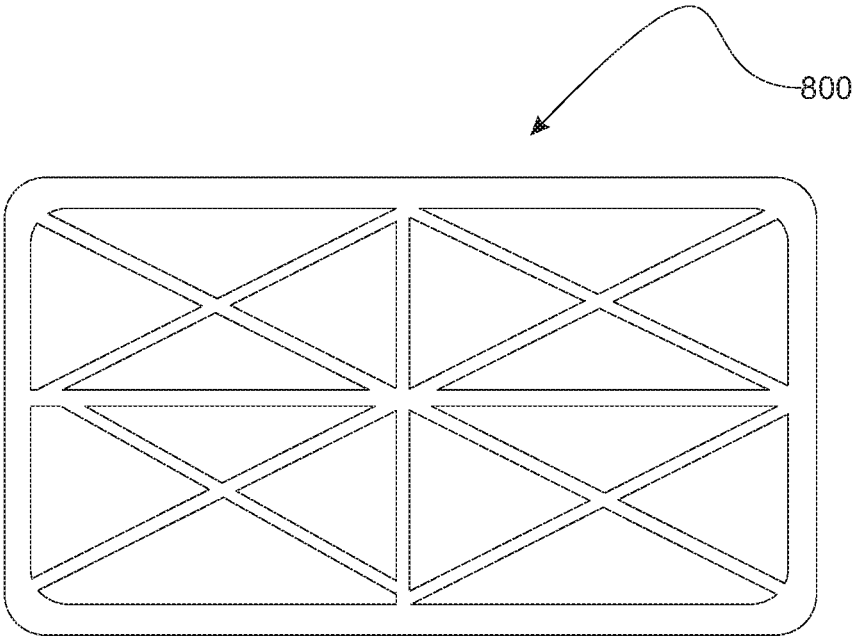
FIG. 8 is a front view of an exemplary embodiment of a webbed framework used for making a panel of the luggage according to the invention.

The stiffening panels 4*a* are made out of a textile envelope and are preferably bordered by rigid continuous frameworks, holding them in position without deformation inside the luggage with a foldable structure. The stiffening panels 4*a* may comprise other items than side frameworks, for example, glass fiber stems, removable or not FIG. 8, according to an advantageous embodiment, the rigid framework 800 inside the textile envelope is a webbed framework. This part 800 is made of plastic by injection molding. In a specific embodiment, the plastic material is reinforced with short glass or polypropylene fibers. This embodiment is stiff and lightweight.

As shown on FIG. 2, the luggage with a foldable structure according to the invention is in a conformation of high volume suitable for its use.

In this conformation of high volume suitable for use, the front part 2*a* is coplanar with the back part 2*b* of the floor 2.

The front and back parts 2*a* and 2*b* are connected by the pivoting link 2*c*.

Side locking means 2*d* are set on the front part 2*a* or on the back part 2*b* alternatively, in the vicinity of the caster R casings.

The locations of the side locking means are preferably set on the interior part 6*a* of the caster R casings 6.

The side locking means 2D may be made of any rigid material, for example out of glass fiber, steel, or rigid plastic.

The spacing of the side locking means, of the front part 2*a* and of the back part 2*b* of the floor 2, makes it possible to avoid the stress concentrations in the middle of the floor 2. It thus avoids the set up of a combined bending in the middle of the floor 2, and the distortion of the wheeling plane at the locations of the caster casings 6, thanks to the forces distribution over a wider width, corresponding to the internal edges of the floor 2.

In the high-volume conformation suitable for use, each stiffening panel 4*a* is fixed and maintained on a front edge of a side face 4 by a Velcro™ strip or by press-studs.

The back of each stiffening panel 4*a* is fixed and maintained at the back of each side face 4 by a hinge 4*c*, which can be made out by the seam of a textile envelope sewed with the back of each side face 4.

Going towards the high-volume conformation, each stiffening panel 4*a* is guided by the hinge 4*c* attached with the back of each side face 4. The rigid swiveling panels 4*a* thus open themselves towards the outside, while being pivotally linked to the back face of the luggage, so that the rigid swiveling panels 4*a* are standing substantially parallel in the high-volume conformation.

Because at least one of the two side faces is associated with at least one stiffening panel adapted to swivel towards the bottom of the foldable luggage, the forces are evenly transmitted from the top to the bottom of the product so that the wheeling is improved.

Thus, thanks to the invention, the luggage with a foldable structure exhibits a stable and rigid structure in the high-volume conformation: the side parts 4 being actually stabilized by the swiveling stiffening panels 4*a* in the high-volume conformation.

Figure 3:
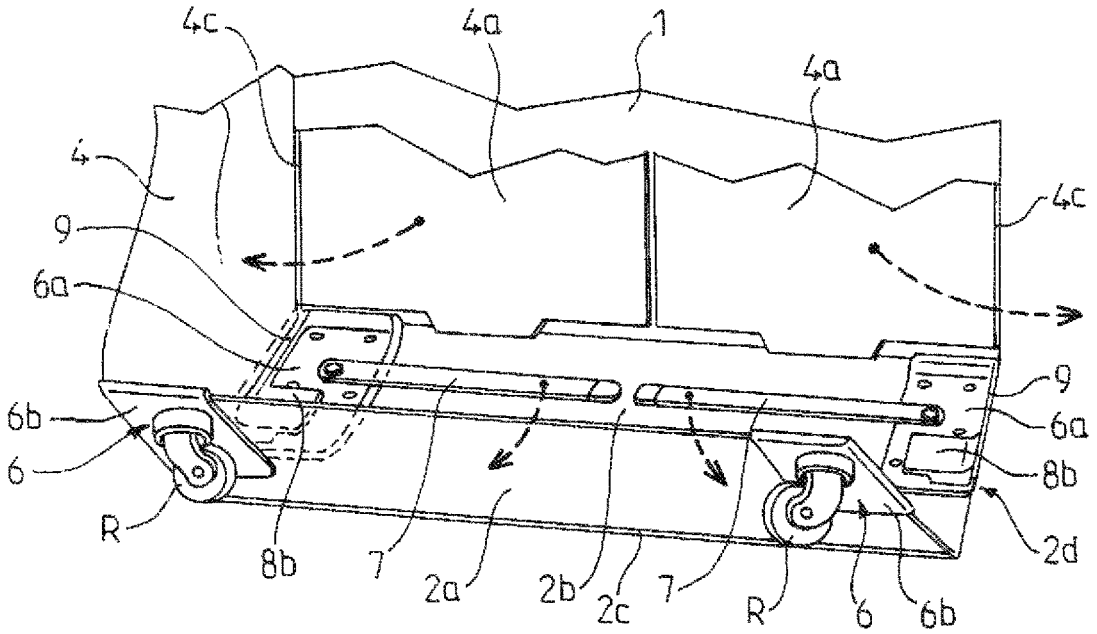
FIG. 3 schematically represents a partial view seen in perspective, showing an exemplary embodiment of locking means adapted to a luggage according to the invention in a folded up conformation.

FIG. 3 shows a locking means for a luggage with a foldable structure according to the invention, in a folded-up conformation with reduced volume, suitable for stowage.

The front and back parts 2*a* and 2*b* are connected by the pivoting link 2*c*.

Side locking means 2D are set on the back part 2*b* according to this exemplary embodiment, in the vicinity of the caster R casings 6.

The locations of the side locking means are directly set on the interior part 6*a* of the caster R casings 6.

The side locking means 2D comprise elongated items 7 made of a rigid material, for example out of glass fiber, steel, or rigid plastic.

The elongated items 7 made of a rigid material are pivotally linked between a free position, substantially parallel with the bottom 1, and a forced position, substantially perpendicular to the bottom 1.

In the free position, substantially parallel with the bottom 1, the elongated items 7, made of rigid a material, do not extend over the pivoting line 2*c*.

In the case of a plurality of elongated items 7 made of a rigid material, the rigid elongated items 7 may be pivotally linked on the front side or on the back side of the floor 2 of the luggage with a foldable structure according to the invention.

When the elongated items 7 made of a rigid material are pivotally linked on the back side, as shown, the swiveling stiffening panels 4*a* are indented at the bottom, so as to enable the crossing above the interior parts 6*a* of the caster R casings 6 of the luggage with a foldable structure.

When the elongated items 7 made of a rigid material are pivot linked on the front of the luggage with a foldable structure, in the vicinity of the access opening, the swiveling stiffening panels 4*a* may not be indented backwards.

Figure 4:
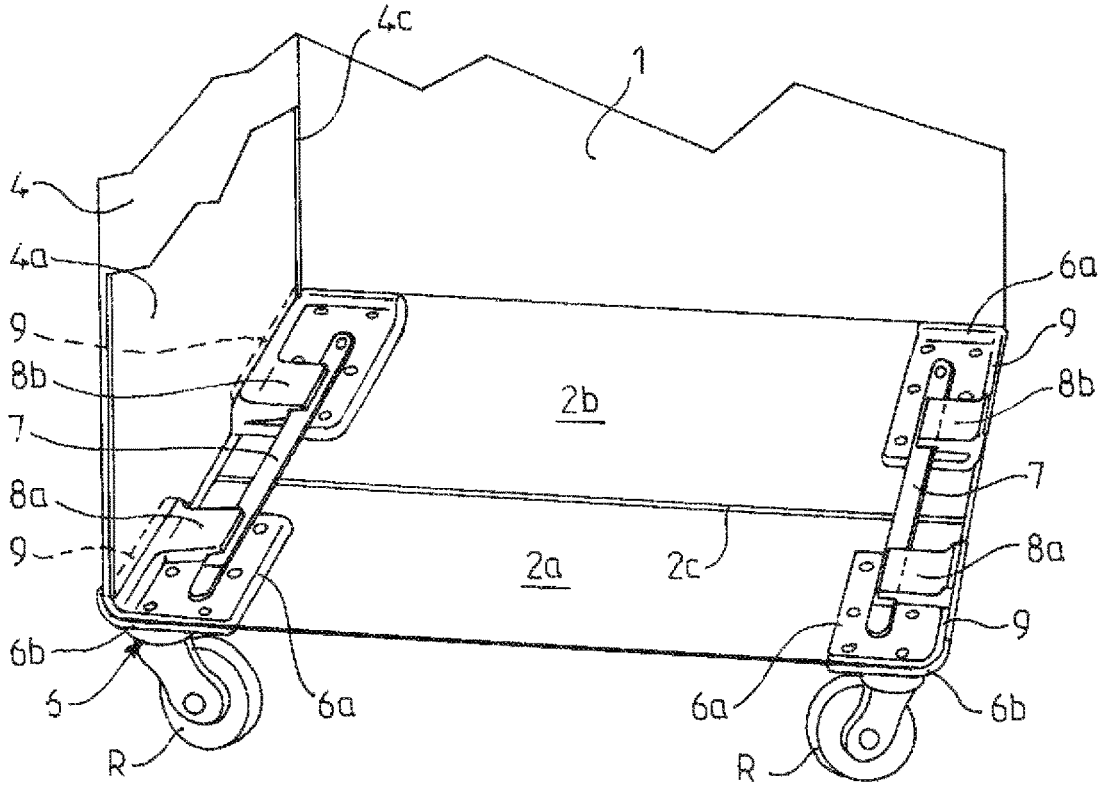
FIG. 4 schematically represents a partial view seen in perspective, showing the locking means of the exemplary embodiment of FIG. 3 when the luggage is in a deployed conformation.

FIG. 4, each elongated item 7 made of a rigid material is locked in two housings 8*a*, 8*b*, thus making a rigid connection that maintains coplanar the front part 2*a* and back pat 2*b* connected by the pivot link 2*c*.

The locations of the housings 8*a*, 8*b* are preferably set on the interior parts 6*a* of the casters R casings 6.

This rigid connection keeping the coplanarity thus provides a good quality of wheeling for the luggage with a foldable structure and with four casters R and a telescopic handle T.

Each elongated item 7 made of a rigid material is embedded in the housings 8*a*, 8*b* which are fixed on the front half-floor 2*a* and on the back half-floor 2*b*, so that no force is applied to the axis of rotation of the elongated item 7 made of a rigid material.

The invention also covers the not shown alternative wherein at least one elongated item 7 made of a rigid material is pivotally assembled in the front half-floor 2*a*, between a free position, substantially parallel with the bottom 1, and one forced position, substantially perpendicular to the bottom 1.

The invention also covers the not shown alternative comprising only one elongated item 7 made of a rigid material, pivotally assembled rotating between a free position, substantially parallel with the bottom 1, and one forced position, substantially perpendicular to the bottom 1.

The invention also covers the not shown alternative comprising more than two elongated items 7 made of a rigid material set up in a different way, but enabling a rigid connection keeping the co-planarity of the front part 2*a* and of the back part 2*b* of the floor 2.

In the embodiment comprising four wheels, the luggage according to the invention comprises lateral means for the rigid connection between a front wheel R and an aft wheel R that are on the same side. This rigid connection is provided by two connection stems 7 connecting the interior wheel casings 6*a* and enabling the stiffening of the foldable floor 2. The invention allows, in the deployed position, to connect the front wheel R with the corresponding aft wheel R, in order to create a rigid link between the two wheels R so as to maintain their co-planarity.

The invention simply provides for two stems or rigid links 7, which directly connect, in the deployed position, in a rigid way, an area close to the front wheel R with an area close to the corresponding aft wheel R.

Thus, at least one stem 7 is able to rotate around a fixed point, located near one of the wheels R, and thus can be placed in two main positions: a folded-up position not connecting the wheels casings and parallel with the bottom 1 of the suitcase, and a deployed position creating a link with another wheel on the other half-floor and perpendicular to the bottom 1 of the suitcase.

The invention thus allows, in the deployed position, to ensure a perfect transmission of the force between the front and the back of the luggage, and to keep the front wheels and the aft wheels in the same plane, so as to enable a perfect wheeling in the four wheels mode.

According to the preferred embodiment of the invention, it is considered to place the system of stems 7 inside the foldable suitcase, to make the attachment, the pivoting and the maintaining units of the stems 7 integral with the interior wheel casings 6*a*, inside the suitcase.

A first wheel casing 6*a*, for example the rear casing at the bottom of the suitcase, holds the stem 7 assembled around a pivoting axis.

An additional housing 8*a* for the wedging of the stem 7 in the deployed position, is designed so as to avoid the transmission of the force to the fixing point and to the pivoting axis of the stem 7.

A second wheel casing 6*a*, for example the casing at the front of the suitcase, bears a housing 8*b* which maintains and locks the stem 7 on the other half-floor, in the deployed position.

The invention also covers the not shown alternative wherein at least one elongated item 7 made of a rigid material is integral with an exterior wheel casing 6*b*.

The invention also covers the not shown alternative wherein at least one elongated item 7 made of a rigid material, is not integral with a wheel casing whether interior or exterior, but is assembled close to it, directly or by means of an insert, in particular in the case when it is made by injection molding in several pieces.

According to the invention implementation, the user starts by unfolding the floor 2, then he fixes the stems 7 to the casings 6*a*. Lastly, he rotates of the swivelling rigid panels, from the interior towards the outside and the front of the luggage with a foldable structure.

At the time of this rotational movement, the bottom of the rigid swivelling panels 4*a*, is likely to bump or to be blocked by the wheel casings 6*a* on the surfaces of housing 8*a*, 8*b* protruding from the floor 2.

When the housings 8*a*, 8*b* maintaining the stem 7 on the interior casings 6*a* are raising obstruction problems during the handling, the swivelling rigid panels 4*a* may be of slightly lower height as compared with the internal height of the suitcase.

The bottom of the rigid swivelling panels 4*a* does not touch the bottom of the product, and are indented, so as to cross above the housings 8*a*, 8*b* of the interior wheel casings 6*a* during rotation.

In this case, each interior wheel casing 6*a* comprises an elevated edge 9 able to provide a counter-bracket for the rigid framework of the swiveling panel 4*a*. This edge 9 makes a shoulder at the edge of the floor panel. This edge 9 not only makes it possible to correctly bear the rigid framework of the swiveling panel 4*a*, but also to compensate for the shortened height of the rigid framework of the swivelling panel 4*a* and to support it at the appropriate height.

Figure 6:
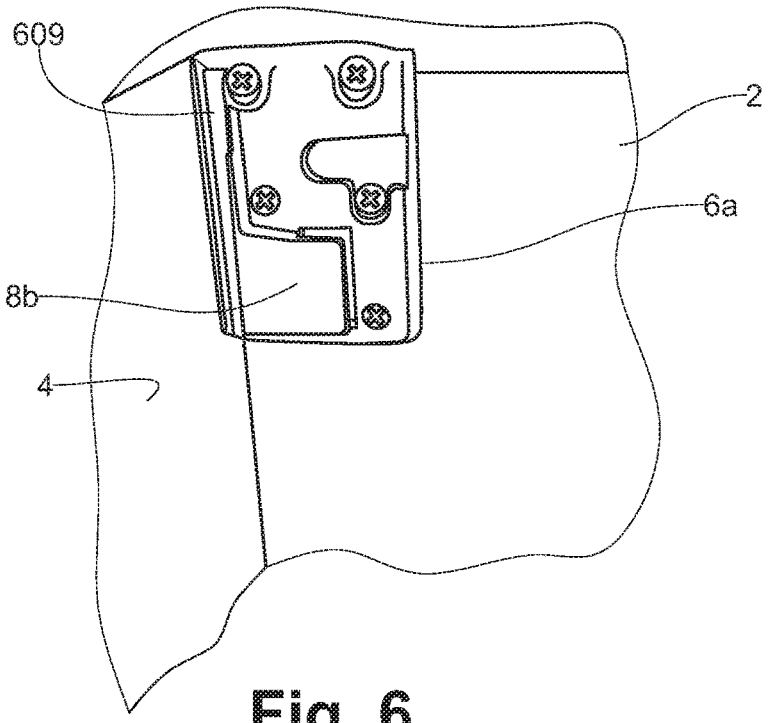
FIG. 6, is a detail view in perspective and seen from the access face of a luggage according to the invention of the interior part of a wheel casing comprising a shoulder groove.

Considering FIG. 6, in a specific embodiment the interior part 6*a* of the casing secure to the floor, comprises at the edge of said floor panel 2 a shoulder groove 609 where the edge of the swiveling stiffening panel is wedged when the said stiffening panel is pivoted from the bottom 1 to the side 4 of the luggage. Therefore, this shoulder groove provides a lock of the trihedral junction between the edges of the stiffening panel and the edges of the floor panel.

Figure 7:
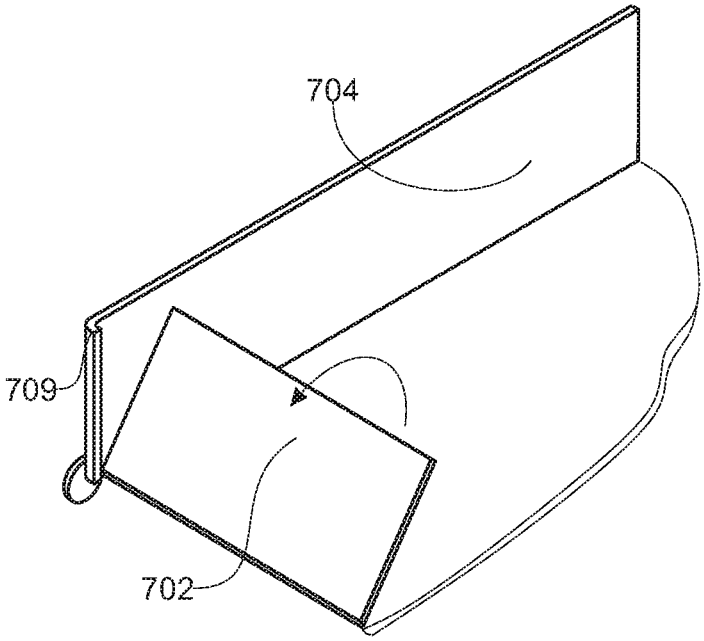
FIG. 7 shows in perspective a partial view of an exemplary embodiment where locking shoulder is part of a side panel.

FIG. 7, in an alternative embodiment better suited for a luggage comprising 2 aft wheels, the locking shoulder 709 is formed at the edge of the side panel 704, so that when going from the folded-up configuration to the use configuration the floor panel 702, or the hinged part of this floor panel 2, is pivoted towards and stopped by this shoulder.

In order to strengthen the rigidity and the stability of the luggage with a foldable structure according to the invention in all conformations corresponding to a chosen volume, it is advantageous to provide additional locking means of the rigid frameworks of the swivelling stiffening panels 4*a*, so as to keep the stiffening panels in the conformation position enabling the transmission of the vertical and side forces.

The invention disclosed in reference to several specific embodiments is by no way limited to them, but covers any modification of shape and any alternative embodiment falling into the scope of the annexed claims.

Thus, the luggage according to the invention may comprise at least one stiffening panel (4*a*) movable in another way, for example at least one stiffening panel (4*a*) able to swivel forwards or towards the access face of the luggage.

Thus, the luggage according to the invention may comprise at least one side maintaining means (2D) articulated in another way, for example at least one foldable means such as a second floor whose pivot axis is transverse with the hinge axis of the side face (2) having a foldable structure and constituting a floor (2) comprising two rigid parts (2*a*, 2*b*) connected between them by a hinge.

The invention claimed is:

1. A substantially prismatic foldable luggage comprising:

four wheeling casters;

a driving handle;

a hard floor, a hard bottom and two hard sides, wherein the hard bottom, the two hard sides and the hard floor being connected in corners by four trihedral junctions, the hard floor extending between aft and front trihedral junctions;

the hard floor comprises a rigid front part and a rigid back part linked by a hinge with a hinge axis parallel to the hard bottom, so that a front part of the hard floor is rotatable towards the hard bottom;

each of the two hard sides comprise a stiffening panel hinged on its first edge with respect to the hard bottom, according to the hinge axis parallel to the hard bottom, the stiffening panels of the two hard sides are not fixed on their second edges such that the stiffening panels are rotatable and foldable towards the hard bottom;

each wheeling caster is beared by a casing comprising an interior part at an interior of the luggage, located in proximity of a trihedral junction and carried by the hard floor; and a pair of locking devices, each locking device comprising a rigid stem pivotally linked at one end to one of the casings, between a locked position where the rigid stem is perpendicular to the hard bottom and connects a pair of front and aft casings and a folded-up position where the rigid stem is not connected to the pair of front and aft casings, and other end of the rigid stem being wedged in a housing integral with the linked casing.

2. The luggage according to claim 1, wherein the interior part of said each casing comprises a shoulder at an edge of a locked panel.

3. The luggage according to claim 2, wherein the interior part of said each casing comprises a shoulder groove configured to lock the second edge of a corresponding stiffening panel.

4. The luggage according to claim 2, wherein the shoulder of said each casing is part of a corresponding hard side.

5. The luggage according to claim 1, further comprising a panel made of a webbed plastic framework wrapped in a textile envelope.

* * * * *